US005340332A

United States Patent [19]

Nakajima et al.

[11] Patent Number: 5,340,332

[45] Date of Patent: Aug. 23, 1994

[54] COAXIAL CABLE CONNECTOR

[75] Inventors: Yoshikatsu Nakajima; Keigo Tatsumi, both of Tokyo, Japan

[73] Assignee: Nakajima Tsushinki Kogyo Co., Ltd., Tokyo, Japan

[21] Appl. No.: 988,098

[22] Filed: Dec. 9, 1992

[51] Int. Cl.[5] ..... H01R 17/04

[52] U.S. Cl. ..... 439/584; 439/583

[58] Field of Search ..... 439/578–585

[56] References Cited

U.S. PATENT DOCUMENTS

| | | | |
|---|---|---|---|
| 4,854,893 | 8/1989 | Morris | 439/578 |
| 4,990,105 | 2/1991 | Karlovich | 439/578 |
| 5,154,636 | 10/1992 | Vaccaro et al. | 439/578 |
| 5,166,477 | 11/1992 | Perin, Jr. et al. | 439/578 |

FOREIGN PATENT DOCUMENTS 62-271381 11/1987 Japan .

*Primary Examiner*—Steven C. Bishop

*Attorney, Agent, or Firm*—Klarquist, Sparkman, Campbell, Leigh & Whinston

[57] ABSTRACT

A coaxial cable connector includes a connector body and a fastening member threadedly engageable with one end of the connector body. The connector body is provided therein with a partition wall defining a cable insulation cover removed end receiving chamber and a terminal pin receiving chamber. The connector body is further provided therein with a reinforcing sleeve integrally secured to the partition wall and a thin deformable sleeve secured to the reinforcing sleeve to form an annular clearance for receiving the external conductor of the coaxial cable between the thin sleeve and the reinforcing sleeve. The connector body is further provided therein an elastic ring surrounding the thin sleeve, and a contractible holding ring surrounding the reinforcing sleeve to form therebetween a clearance permitting the external conductor of the coaxial cable passing therethrough. An urging unit is provided which moves into the connector body to urge the elastic ring and the contractible holding ring when the fastening member is connected to the one end of the connector body, thereby completely clamping the external conductor of the coaxial cable to the connector.

11 Claims, 1 Drawing Sheet

COAXIAL CABLE CONNECTOR

BACKGROUND OF THE INVENTION

The present invention relates to a coaxial cable connector including a connector body for receiving an insulation cover removed end of a coaxial cable inserted into one end of the connector body, a terminal pin having a connection to be fitted with the core of the coaxial cable and provided in the connector body to extend from the other end of the connector body opposite to the one end, cable fixing means connectable to said one end of the connector body and clamping and sealing the inserted coaxial cable when the cable fixing means is connected to the connector body, and additionally reinforcing sleeve means to be fitted in the cylindrical external conductor of the coaxial cable to reinforce the external conductor when the coaxial cable is clamped.

Such a coaxial cable connector has been known, for example, as disclosed in Japanese Patent Application Laid-open No. 62-271,381. In the disclosed coaxial cable connector, reinforcing sleeve means consists of a reinforcing sleeve separately formed from a connector body. The reinforcing sleeve has an outer diameter slightly smaller than the inner diameter of the external conductor of a coaxial cable and an enlarged annular lip having an outer diameter substantially equal to the outer diameter of the external conductor of the coaxial cable. After the reinforcing sleeve has been fitted in the external conductor of the end of the coaxial cable whose inner and outer coatings have been removed, the coaxial cable is inserted into one end of the connector body. When the end face of the enlarged annular lip of the reinforcing sleeve inserted in the external conductor of the coaxial cable abuts against the corresponding abutment surface in the connector body, a cable fixing-means is threadedly engaged into the one end of the connector, thereby sealingly clamping and connecting the coaxial cable to the connector body.

In the prior art connector, however, it is needed to insert the reinforcing sleeve as a part separate from the connector body into the external conductor of the coaxial cable. Moreover, the end face of the reinforcing sleeve fitted in the external conductor is not necessarily maintained in an abutment against the corresponding abutting surface of the connector body at all times.

Furthermore, owing to practical working, manufacturing and used conditions, it is impossible to bring the end face of the reinforcing sleeve into completely close abutment all over the end face against the corresponding abutting surface of the connector body and always to keep this complete abutment. However, if the close abutment of them is not always completely maintained, there is a tendency of leakage of internal electromagnetic waves or disturbance of external electromagnetic waves to occur.

In using this coaxial cable connector for transmitting aural signals and/or video signals, for example, CATV (community antenna television) signals and at the same time transmitting and receiving various control signals of computers, the leakage of internal electromagnetic waves or disturbance of external electromagnetic waves would cause malfunctional operation of controls to give rise to serious situation.

SUMMARY OF THE INVENTION

It is a first object of the invention to provide a coaxial cable connector which achieves and always maintains close contact of the external conductor of a coaxial cable with the connector body without requiring any troublesome fitting operation of a reinforcing sleeve as a different part in the external conductor to preclude any leakage of electromagnetic waves or disturbance of external electromagnetic waves.

It is a second object of the invention to provide a coaxial cable connector capable of completely tightly joining its connector body with members to be connected thereto to preclude any leakage of electromagnetic waves or disturbance of external electromagnetic waves.

In order to accomplish the first object, according to the invention the connector body is provided therein with a partition wall having a center opening permitting the core of the coaxial cable to pass therethrough to define a cable insulation cover removed end receiving chamber for receiving the insulation cover removed end of the coaxial cable, and said reinforcing sleeve means is a reinforcing sleeve fixed to said partition wall coaxially to its center axis and having an outer diameter slightly smaller than the inner diameter of the cylindrical external conductor of the coaxial cable, and further said coaxial cable connector comprises a thin deformable sleeve shorter than the reinforcing sleeve and connectable to the outside of the reinforcing sleeve to form an annular clearance for receiving the external conductor of the coaxial cable between the thin deformable sleeve and the reinforcing sleeve, an elastic ring surrounding the outer circumference of the thin sleeve, a contractible holding ring spaced from the free end of the thin sleeve and surrounding the outer circumference of the reinforcing sleeve to form therebetween a clearance permitting of the external conductor of the coaxial cable passing therethrough, and urging means moving in the connector body to urge the elastic ring and the contractible holding ring when the cable fixing means is connected to the one end of the connector body.

In a preferred embodiment of the invention, the elastic ring has at its outer end a truncated conical end or frustoconical end and the contractible holding ring has at both its ends truncated conical ends or frustoconical ends, respectively, and further the urging means comprises an urging sleeve arranged in the connector body and having inclined cam surfaces to engage the truncated conical ends or frustoconical ends at the outer end of the elastic ring and inner end of the holding ring, respectively, an urging ring arranged in the connector body and having inclined surface to engage the frustoconical end at the outer end of the holding ring, and an urging ring arranged in the cable fixing means to urge the first mentioned urging ring inwardly of the connector body when the cable fixing means is being connected to the one end of the connector body.

In another embodiment of the invention, the connector further comprises annular mesh wires arranged at the bottom of the annular recess between the reinforcing sleeve and the thin sleeve.

In a further embodiment of the invention, the connector further comprises annular mesh wires having an inner diameter slightly greater than the outer diameter of the external conductor of the coaxial cable and arranged around the reinforcing sleeve and in opposition to the free end of the thin sleeve.

In order to accomplish the second object, a coaxial cable connector according to the invention comprises a connector body having a partition wall defining therein a cable insulation cover removed end receiving chamber and a terminal pin receiving chamber, and a terminating member detachably threadedly connectable to said terminal pin receiving chamber of the connector body and provided therein with a terminal pin having a connection to be fitted with the core of a coaxial cable, and the terminal pin receiving chamber being formed on its bottom with a small annular protrusion uniformly slightly projecting from the bottom and having a sharp annular tip which is to be deformed and collapsed when the end face of said terminating member abuts against the annular protrusion.

According to the invention, first the reinforcing sleeve is integrally secured to the connector body, and second the thin sleeve having one end closely fixed to the reinforcing sleeve without any clearances is brought into close contact with the external conductor over all its circumference, (which may form passages for electromagnetic waves) without any clearances by deforming the thin sleeve with the aid of the deformation of the elastic ring caused by the fastening member in screwing it into the connector body. With the arrangement, any leakage of electromagnetic waves can be completely prevented, which would occur with a coaxial cable terminated in a connector body.

According to the invention, moreover, the mesh wires are arranged between the enlarged end of the reinforcing sleeve and the forward end of the external conductor of the coaxial cable and further around the center zone of the external conductor. When the fastening member is threadedly engaged into the connector body, the mesh wires are compressed to ensure the reliable electrical connection of the external conductor to the reinforcing sleeve and the thin sleeve, thereby preventing change in impedance.

With the terminating member detachably connectable to the connector body, according to the invention the terminal pin receiving chamber is formed at its bottom with the small annular protrusion having the sharp annular tip, which is collapsed to fill clearances between the end face of the terminating member and the bottom of the terminal pin receiving chamber when the terminating member is threadedly engaged into the chamber, thereby completely precluding the possibility of leakage of electromagnetic waves.

The invention will be more fully understood by referring to the following detailed specification and claims taken in connection with the appended drawings.

DESCRIPTION OF THE PREFERRED EMBODIMENTS

Figure 1:
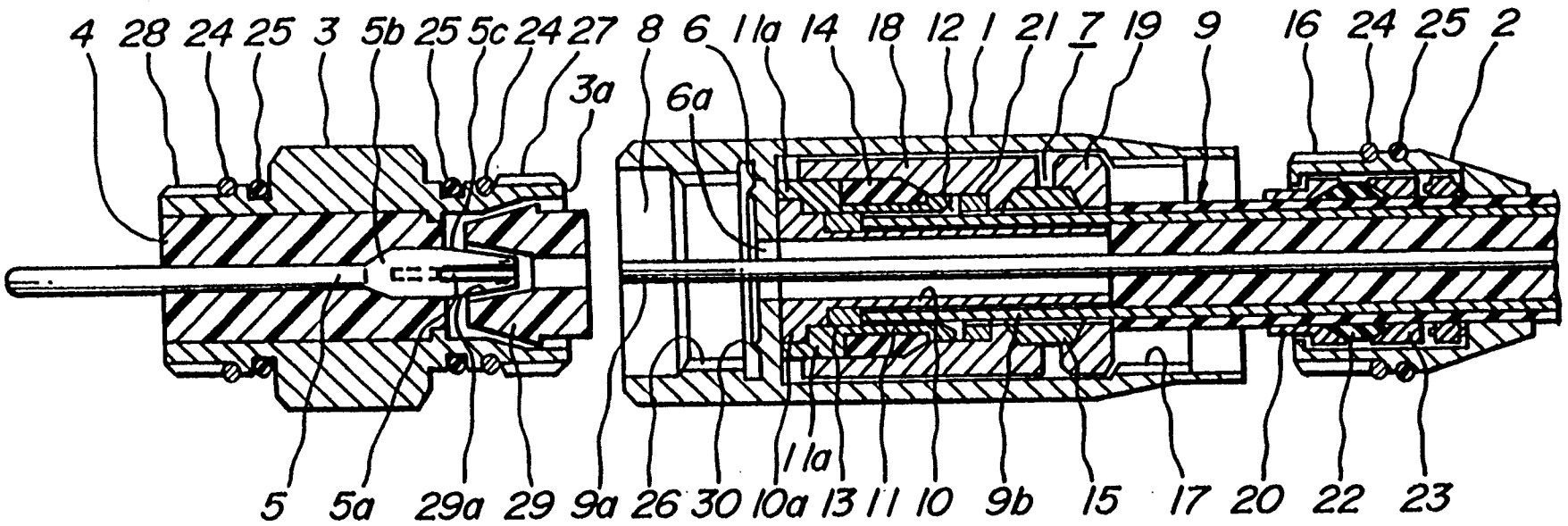
FIG. 1 is an exploded partial sectional view illustrating the coaxial cable connector according to one embodiment of the invention.

In the embodiment of the invention shown in FIG. 1, the coaxial cable connector comprises a metallic connector body 1, a metallic fastening member 2 as cable fixing means adapted to be threadedly engaged in the threaded hole of the connector body 1 at its one end, and a metallic terminating member 3 adapted to be threadedly engaged in the threaded hole of the connector body 1 at the other end. The metallic fastening member 2 serves to clamp and seal the insulation cover removed end of a coaxial cable inserted in the one end of the connector body 1. A terminal pin 5 is fixed at the center of the terminating member 3 by means of an electrically insulating material 4 interposed therebetween.

The interior of the connector body 1 is divided by a partition wall 6 into a cable insulation cover removed end receiving chamber 7 for receiving the insulation cover removed end of the coaxial cable and a terminal pin receiving chamber 8 for receiving the terminal pin 5. The partition wall 6 is formed at its center with an opening **6*a* through which the core 9*a* of the insulation cover removed end of the coaxial cable passes so that the chambers 7 and 8 are communicated with each other. A reinforcing sleeve 10 made of a metal is provided to be fitted in the cylindrical external conductor 9*b* of the insulation cover removed end of the coaxial cable 9 in order to reinforce the external conductor 9*b*. A thin deformable sleeve 11 made of a metal shorter than the reinforcing sleeve 10 is coaxially arranged around the reinforcing sleeve 10. To this end, enlarged ends 10*a* and 11*a* of the reinforcing sleeve 10 and thin sleeve 11 are fixed to the partition wall 6 on the side of the cable insulation cover removed end receiving chamber 7 by means of a caulking ring, welding or others. The opening 6 preferably has a diameter substantially equal to the inner diameter of the reinforcing sleeve 10**.

It is preferable that the enlarged end **10*a* of the reinforcing sleeve 10 is formed with two shoulders, while the enlarged end 11*a* of the thin sleeve 11 is formed with an annular recess which is snugly fitted on the shoulders of the reinforcing sleeve 10. The outer diameter of the reinforcing sleeve 10 is slightly smaller than the inner diameter of the external conductor 9*b* of the coaxial cable 9. On the other hand, the inner diameter of the thin sleeve 11 is slightly greater than the outer diameter of the external conductor 9*b* of the coaxial cable 9. Consequently, the reinforcing and thin sleeves 10 and 11 form therebetween an annular gap 12 for receiving the external conductor 9*b*. Annular mesh wires 13 made of a metal are arranged in the annular gap 12 at the end of the external conductor 9*b*** in the shown embodiment.

An elastic ring 14 made of an electrically insulating rubber or polyethylene is arranged around the thin sleeve 11. A contractible holding ring 15 made of a metal is further arranged around the reinforcing sleeve 10 axially spaced a distance from the free end of the thin sleeve 11 to form a clearance between the holding ring 15 and the reinforcing sleeve 10 for inserting the external conductor **9*b* of the coaxial cable 9. The contractible holding ring 15 is formed on its inside with saw-toothed serrations or screw threads. The outer end of the elastic ring 14 is tapered to form a truncated conical end or frustoconical end. Both the ends of the contractible holding ring 15 are also tapered to form truncated conical ends or frustoconical ends. Moreover, urging means is provided which moves into the connector body 1 to urge the elastic ring 14 and the contractible holding ring 15 when the externally threaded end 16 of the fastening member 2 is being engaged within the internally threaded end 17 of the connector body 1. In the shown embodiment, the urging means consists of an urging sleeve 18 and an urging ring 19 both arranged in the connector body 1 and an urging ring 20 arranged in the fastening member 2**.

The urging sleeve and ring 18 and 19 have inclined cam surfaces adapted to engage the tapered surfaces or truncated conical ends of the elastic and holding rings 14 and 15. When the urging ring 19 is urged inwardly of the connector body 1, the elastic and holding rings 14 and 15 are axially inwardly compressed and radially expanded correspondingly to the axial contraction by the axially inward compression. However, the inclined cam surfaces of the urging sleeve and ring 18 and 19 serve to urge the elastic and holding rings 14 and 15 radially inwardly to securely clamp the thin sleeve 11 and the external conductor 9*b* of the coaxial cable 9. It is preferable to arrange annular mesh wires 21 made of a metal having an inner diameter slightly greater than the outer diameter of the external conductor 9*b* of the coaxial cable 9 and arranged around the reinforcing sleeve 10 and in opposition to the free end of the thin sleeve 11.

In addition to the urging ring 20, the fastening member 2 is provided therein with an electrically insulating elastic ring 22 adjacent the urging ring 20 and more preferably a reaction urging ring 23 adjacent the elastic ring 22. The inner diameters of the urging ring 20, the elastic ring 22 and reaction urging ring 23 are slightly greater than the outer diameter of the outer insulating coating of the coaxial cable 9 to permit it to pass through these rings 20, 22 and 23. Moreover, the elastic ring 22 is formed at both its axial ends with tapered surfaces in the form of truncated cones or frustocones. The urging and reaction urging rings 20 and 23 are formed on the sides of the elastic ring 22 with tapered surfaces, respectively, which are adapted to engage the truncated conical surfaces or frustoconical surfaces of the elastic ring 22. Moreover, on the outer circumference of the fastening member 2 to be fitted in the connector body 1 are provided annular mesh wires 24 made of a metal for preventing leakage of electromagnetic waves and an O-ring 25 for water-proof.

The connector body 1 is formed in the terminal pin receiving chamber 8 with an internally threaded portion 26, while the terminating member 3 is formed on its one end with an externally threaded portion 27 adapted to engage the internally threaded portion 26 of the connector body 1. On the other hand, the terminating member 3 is formed on the other end with an externally threaded portion 28 adapted to engage the connection (not shown) of an appliance or the like to be electrically connected to the terminal pin 5 provided in the terminating member 3.

On the side of the connector body 1, the terminal pin 5 is provided with a connection 5*b* having a receiving hole 5*a* in which the core 9*a* of the coaxial cable 9 is fitted. The connection 5*b* is formed with a tapered outer surface 5*c* in the form of a truncated cone or frustocone tapered toward its tip end. The tapered portion of the connection 5*b* is formed with axial slits extending through the receiving hole 5*a*. The end of the terminal member 3 to be connected to the connector body 1 is further provided with a connection clamp member 29 of an electrically insulating material which is axially slidable in the terminating member 3 within an axially limited range. The connection clamp member 29 is formed therein with a tapered inner surface 29*a* snugly fitted with the tapered outer surface 5*c* of the terminal pin 5 when the connection 5*b* of the terminal pin 5 is inserted into the tapered inner surface 29*a*.

The terminal pin receiving chamber of the connector body 1 is formed on its bottom with a small annular protrusion 30 having a sharp annular tip against which the end face 3*a* of the terminating member 3 abuts when it is threadedly engaged in the terminal pin receiving chamber 8 of the connector body 1.

In order to clamp a coaxial cable 9 in the connector body 1, first the cable 9 is extended through the fastening member 2 so that the external conductor 9*b* of the insulation cover removed end of the coaxial cable 9 is inserted into the annular space 12 between the thin sleeve 11 and the reinforcing sleeve 10 of the connector body 1. When the external conductor 9*b* has been completely inserted into the space 12, the external conductor 9*b* contacts and collapses the annular mesh wires 13 arranged at the bottom of the annular space 12 to ensure the electrical contact between the external conductor 9*b* and the reinforcing sleeve 10 and to preclude the clearance therebetween to some extent.

Thereafter, the fastening member 2 is threadedly engaged into the connector body 1. As a result, the urging ring 20 provided in the fastening member 2 causes the urging ring 19 arranged in the connector body 1 to urge inwardly thereof so that the contractible holding ring 15 and the urging sleeve 18 are pressed inwardly of the connector body 1.

During such an operation, the urging sleeve 18 is moved axially inwardly of the connector body 1 to compress the elastic ring 14 in the axial direction. Consequently, the elastic ring 14 expands radially inwardly and outwardly because it is prevented from axially moving by the shoulder of the enlarged end 11*a* of the thin sleeve 11. In conjunction with the inward urging action of the inclined cam surface of the urging sleeve 18 described above, the radially inward expansion of the elastic ring 14 causes the thin sleeve 11 to be radially contracted to bring it into close contact with all the circumference of the external conductor 9*b* of the coaxial cable 9, thereby completely precluding the possibility of leakage of electromagnetic waves between the connector body 1 and a coaxial cable.

Moreover, the axially inward movement of the contractible holding ring 15 also causes the annular mesh wires 21 to be collapsed between the contractible holding ring 15 and the free end of the thin sleeve 11 to ensure the complete electrical contact between the thin sleeve 11 and the external conductor 9*b* of the coaxial cable 9 and to preclude any clearance therebetween to prevent the possibility of leakage of electromagnetic waves thereat.

The contractible holding ring 15 is moved together with the urging sleeve 18 and the urging ring 19 arranged on both the sides of the holding ring 15. However, when the urging sleeve 18 has just arrived at the limit of its movement, the contractible holding ring 15 is axially compressed between the urging sleeve 18 and the urging ring 19 so as to be contracted radially inwardly by the action of the inclined cam surfaces of these members as described above. Consequently, the external conductor 9*b* of the cable 9 is pinched by the contracted holding ring 15 to ensure the mechanical holding of the external conductor 9*b* to the connector body 1 in a reliable manner.

When the fastening member 2 is threadedly engaged into the connector body 1, the urging ring 20 in the fastening member 2 engages the urging ring 19 in the connector body 1 so that the urging ring 20 moves axially inwardly of the fastening member 2 to compress the elastic ring 22 in axial directions between the urging ring 20 and the reaction urging ring 23. Consequently, the elastic ring 22 expands radially inwardly and outwardly to contact the outer coating of the coaxial cable 9 closely, thereby preventing any water from penetrating into the connector body along the external coating of the coaxial cable 9.

If a terminating member 3 is integrally formed with a connector body 1, by inserting and clamping the insulation cover removed end of the coaxial cable 9 into the connector body 1, the core 9*a* of the coaxial cable 9 is fitted and contacted with the connection of the terminal pin to complete the connecting and clamping the coaxial cable to the connector body.

With the terminating member 3 detachably connectable to the connector body 1 as in the shown embodiment, however, the core 9*a* of the coaxial cable 9 is exposed in the terminal pin receiving chamber 8. In this case, the core 9*a* of the coaxial cable 9 is inserted into the opening of the connection clamp member 29 and the terminating member 3 is threadedly engaged into the terminal pin receiving chamber 8. When the terminating member 3 has been completely threadedly engaged in the terminal pin receiving chamber 8, the end face 3*a* of the terminating member 3 abuts against the small annular protrusion 30 so as to collapse it. Therefore, even if the end face 3*a* of the terminating member 3 is irregularly uneven, the collapsed protrusion 30 fills up the unevenness on the end face 3*a* of the terminating member 3 so that the bottom surface of the terminal pin receiving chamber 8 comes into close contact with the end face 3*a* of the terminating member 3 without any clearance all over its end face 3. Consequently, any leakage of electromagnetic waves can be securely prevented even if there are unavoidable spiral clearances in the screw thread connection between the connector body 1 and the terminating member 3.

As can be seen from the above description, the coaxial cable connector according to the invention can accomplish the reliable electrical connection of a coaxial cable to the connector body to preclude any leakage of internal electromagnetic waves and disturbance of external electromagnetic waves.

While the invention has been particularly shown and described with reference to preferred embodiments thereof, it will be understood by those skilled in the art that the foregoing and other changes in form and details can be made therein without departing from the scope of the claims.

What is claimed is:

1. A coaxial cable connector comprising:

a connector body having a first and a second end and adapted to receive into said first end of the connector body an end of a coaxial cable with insulation cover removed, a terminal member connectable to the second end of the connector body and including a terminal pin having a connection adapted to receive a core of the coaxial cable mounted to said connector body, cable fixing means connectable to the first end of the connector body and clamping and sealing the inserted coaxial cable when the cable fixing means is connected to the connector body, a reinforcing sleeve adapted to be fitted in the tubular external conductor of the coaxial cable to reinforce the tubular external conductor when the coaxial cable is clamped, the connector body having a partition wall having a center bore to permit the core of the coaxial cable to pass therethrough, said partition wall and the first end of the connector body defining a cable receiving chamber for receiving the end of the coaxial cable with insulation cover removed, said reinforcing sleeve having a base portion fixed to said partition wall and a tubular portion extending from the base portion coaxially to the core of the coaxial cable and having an outer diameter slightly smaller than the inner diameter of the tubular external conductor of the coaxial cable, a third deformable sleeve having a base portion connected to the base portion of the reinforcing sleeve, and a tubular portion extending from the base portion of said thin deformable sleeve across a first part of the reinforcing sleeve to form an annular space for receiving the tubular conductor of the coaxial cable between the tubular portions of the thin deformable sleeve and the reinforcing sleeve, an elastic ring surrounding the tubular portion of the thin deformable sleeve, a contractible holding ring spaced from the tubular portion of the thin deformable sleeve and surrounding the outer circumference of a second part of the reinforcing sleeve to form therebetween an annular space to permit the external conductor of the coaxial cable to pass therethrough, and urging means positioned in the connector body to urge the elastic ring and the contractible holding ring when the cable fixing means is connected to the first end of the connector body.

2. The coaxial cable connector of claim 1, wherein said elastic ring has a truncated conical end and said contractible holding ring has first and second truncated conical ends, and wherein said urging means comprises an urging sleeve arranged in the connector body and having inclined cam surfaces to engage the truncated conical end of the elastic ring and the first truncated end of the contractible holding ring, a first urging ring arranged in the connector body and having an inclined surface to engage the second truncated conical end of the contractible holding ring, and a second urging ring arranged in the cable fixing means to urge the first urging ring inwardly of the connector body when the cable fixing means is being connected to the first end of the connector body.

3. The coaxial cable connector of claim 1, wherein said coaxial cable connector further comprises a first annular element formed of wire mesh arranged in an annular recess defined by the base portion of the reinforcing sleeve and the tubular portions of the thin deformable sleeve and the reinforcing sleeve.

4. The coaxial cable connector of claim 1, wherein said coaxial cable connector further comprises a second annular element formed of wire mesh, said second element having an inner diameter slightly greater than the outer diameter of the external conductor of the coaxial cable and arranged around the second part of the reinforcing sleeve.

5. The coaxial cable connector of claim 1, wherein said terminal member is threadedly engageable in a terminal pin receiving chamber defined by said partition wall in said connector body and the second end of the connector body opposite said cable receiving chamber, and said terminal pin receiving chamber having an annular protrusion uniformly slightly projecting from said partition wall and having a sharp annular tip which is to be deformed and collapsed when said terminal member abuts against the annular protrusion.

6. A coaxial cable connector comprising:

a connector body having a partition wall defining therein a cable receiving chamber on a first side of said partition wall and a terminal pin receiving chamber on a second side of said partition wall, and a terminating member detachably threadedly connectable to said terminal pin receiving chamber of the connector body and provided therein with a terminal pin having a connection to be fitted with a core of a coaxial cable, and said terminal pin receiving chamber having an annular protrusion uniformly slightly projecting from said partition wall and having a sharp annular tip which is to be deformed and collapsed when said terminating member abuts against the annular protrusion.

7. A coaxial cable connector for coupling a coaxial cable of predetermined dimension having a center conductor and an external conductor coaxial with the center conductor, comprising:

a connector body having an inner chamber divided into a cable receiving chamber and a termination chamber by a partition wall having a center bore to allow the center conductor of the coaxial cable to pass therethrough;

a reinforcing sleeve element fixed to the partition wall in the cable receiving chamber, said sleeve element including a base portion and a tubular portion extending from said base portion, said tubular portion having an outer surface of a diameter slightly smaller than the external conductor of the coaxial cable;

a thin deformable sleeve element having a base portion and a tubular portion, the base portion of said thin deformable sleeve element being mounted on the base portion of said reinforcing sleeve element and the tubular portion of said thin deformable sleeve extending coaxially along a first part of the tubular portion of said reinforcing sleeve to form a first annular space between said reinforcing sleeve element and said thin deformable sleeve element for receiving the external conductor of the coaxial cable;

an elastic ring surrounding the tubular portion of said thin deformable sleeve element;

a contractible holding ring positioned in the cable receiving chamber, spaced from the tubular portion of said thin deformable sleeve element, and surrounding a second part of the tubular portion of said reinforcing sleeve to form a second annular space to permit the external conductor of the coaxial cable to pass therethrough; and urging members positioned in the connector body and movable therein to deform the elastic ring and the contractible holding ring radially upon predetermined movement of said urging members relative to said body.

8. The coaxial cable connector of claim 7 further comprising a cable fixing means for clamping and sealing a coaxial cable, connectable to the connector body;

wherein the elastic ring has a truncated conical end and the contractible holding ring has first and second truncated conical ends, and wherein said urging means comprises:

an urging sleeve arranged in the connector body and having inclined cam surfaces to engage the truncated conical end of the elastic ring and the first truncated end of the contractible holding ring;

a first urging ring arranged in the connector body and having an inclined surface to engage the second truncated conical end of the contractible holding ring;

and a second urging ring arranged in the cable fixing means to urge the first urging ring inwardly of the connector body when the cable fixing means is being coupled to the connector body.

9. The coaxial cable connector of claim 7 further comprising annular mesh wires arranged between the reinforcing sleeve and the thin deformable sleeve.

10. The coaxial cable connector of claim 7 further comprising a terminal member threadedly engageable to the terminating chamber of the connector body, the terminal member having a terminal pin with a connection clamp for coupling to the center conductor of the coaxial cable.

11. The coaxial cable connector of claim 7 wherein the terminating chamber has a small annular protrusion extending from the partition wall.

* * * * *